United States Patent [19]

Davenport et al.

[11] Patent Number: 5,032,758

[45] Date of Patent: Jul. 16, 1991

[54] PRECISION TUBULATION FOR SELF MOUNTING LAMP

[75] Inventors: John M. Davenport, Lyndhurst; Richard L. Hansler, Pepper Pike, both of Ohio; Maw H. Lee, Pittsford, N.Y.

[73] Assignee: General Electric Company, Schenectady, N.Y.

[21] Appl. No.: 413,815

[22] Filed: Sep. 28, 1989

[51] Int. Cl.[5] ..... H01J 5/16

[52] U.S. Cl. ..... 313/113; 313/318; 362/296; 362/310

[58] Field of Search ..... 313/110, 113, 623, 318; 362/296, 310, 341

[56] References Cited

U.S. PATENT DOCUMENTS

| | | | |
|---|---|---|---|
| 4,389,201 | 6/1983 | Hansler et al. | 445/26 |
| 4,423,348 | 12/1983 | Greiler | 313/113 |
| 4,533,851 | 8/1985 | Block et al. | 313/623 X |
| 4,626,734 | 12/1986 | Greiler | 313/113 X |
| 4,810,932 | 3/1989 | Ahlgren et al. | 313/315 X |
| 4,878,161 | 10/1989 | Nakata | 313/113 X |

FOREIGN PATENT DOCUMENTS

| | | | |
|---|---|---|---|
| 2034455 | 6/1980 | United Kingdom | 313/113 |

*Primary Examiner*—Donald J. Yusko
*Assistant Examiner*—Michael Horabik
*Attorney, Agent, or Firm*—Edward M. Corcoran; Stanley C. Corwin; Fred Jacob

[57] ABSTRACT

An electric lamp fabricated from lamp tubing and terminating at one end in an elongated tubular portion which is of a precise, predetermined length with respect to the optical center of the lamp is inserted directly into and held in a bore in the rear of a reflector so that the optical center of the lamp is at the focal point of the reflector without need for adjusting the position of the lamp in the reflector.

21 Claims, 4 Drawing Sheets

PRECISION TUBULATION FOR SELF MOUNTING LAMP

BACKGROUND OF THE INVENTION

1. Field of the Invention

The present invention relates to electric lamps having an elongated tubular portion for inserting directly into a lamp mount or reflector base. More particularly, the present invention relates to electric lamps having an elongated tubular portion of a precise, predetermined length with respect to the optical center of said lamp, wherein at least a portion of said tubular portion is inserted directly into and secured in a bore of predetermined length in a plastic lamp mount or reflector so that the optical center of the lamp is at the focal point of the reflector without the need for adjustment, and mount and reflector assemblies containing such lamps.

2. Background of the Disclosure

There is much interest in the automobile industry in using tungsten-halogen lamps and arc lamps as the light sources for automotive headlamps. Tungsten-halogen lamps are presently in such use. Arc lamps have potentially longer life and higher light output and, further, the size of such arc lamps, such as metal halide arc discharge lamps, required for such lighting applications is relatively small, thereby enabling automotive manufacturers a greater leeway in innovative automotive design.

Tungsten-halogen lamps presently employed for automotive lighting in standard sealed beam headlamp units are generally welded to formed wires or posts which are then soldered or brazed to the lamp reflector through electrical feed-through members. Federal regulations are very stringent with regard to strength requirements for lamp sources for replaceable or composite lamps. Accordingly, such lamps are usually retained to a fixture by means of a strap member which is then welded to a metal member for the purpose of focusing and retaining the lamp in the base and in the reflector. U.S. Pat. No. 4,470,104 discloses a means for mounting a tungsten-halogen lamp wherein the lamp, due to temperature and other considerations, is held in place by metal members. Still another means for mounting a tungsten halogen lamp in an automotive type lamp assembly is disclosed in U.S. Pat. No. 4,754,373 in which the lamp is held in place by metal members proximate to the lamp.

In replaceable headlamps the position of the lamp filament relative to the lamp mount inserted into the rear of the reflector must occur within very narrow limits in order to have the focal point of the filament positioned reasonably close to the focal point of the reflector after the lamp and mount assembly are attached to the reflector. To obtain this kind of precision using existing technology, a complicated mounting arrangement is required so that the lamp may be moved relative to the lamp mount or base in order to position the optical center of the lamp within specified limits relative to the mount structure and then welded or otherwise secured to the mount. The lamp and mount assembly is then attached to the reflector in a precise fashion so that the optical center of the lamp corresponds with the focal point or optical center of the reflector. Examples of such complicated lamp mount structures and their use with reflectors are disclosed, for example, in U.S. Pat. Nos. 4,774,645; 4,795,388 and 4,795,936.

In contrast to tungsten-halogen lamps, arc discharge lamps, such as metal halide arc discharge lamps, require extremely high starting voltages, usually in the range of 10,000 to 20,000 volts. Because of these high voltages, it is necessary to electrically isolate the lead wires which exit the quartz or glass lamp envelope. Additionally, some of these lamp designs require very high starting frequencies in the order of 50 kHz in order to initiate the arc and at these high frequencies metallic parts in the proximity of the hot lead wire tend to increase the capacitance of the system. The result of this increased capacitance is to decrease the level of voltage delivered to the lamp for the purpose of initiating the arc. Further, corona discharge sometimes occurs between the hot lead wire and metal parts proximate to the lamp or lead wire. Accordingly, it is therefore desirable to limit the capacitance of the system by removing all but absolutely essential metallic elements from around the lamp. The use of metallic straps around the arc tube seal or otherwise in the proximity of the arc or high voltage lead would reduce the ability of the lamp to start or require higher voltages and, thus, more expensive electronics for starting a lamp in order to compensate for capacitance losses.

Still another phenomena which complicates the use of a scheme for supporting a metal arc discharge lamp relates to sodium loss from the arc chamber. Most arc tubes require compounds of sodium and one or more halogens to enhance their efficiency. Under certain conditions sodium ions can migrate through the quartz (or high temperature glass) arc chamber walls and the corresponding loss of sodium in the lamp results not only in hard starting or failure to start but darkening of the lamp envelope. Sodium migration out of the arc chamber also seems to be enhanced by the presence of metals near the arc chamber. This is a well known phenomenon in the lamp industry and larger metal halide lamps are designed to avoid or minimize the presence of metal near the arc chamber.

SUMMARY OF THE INVENTION

The present invention relates to precision tubulation for self mounting an elongated tubular portion of an electric lamp directly into an electrically non-conductive base or lamp mount. The lamps employed in accordance with the present invention have a vitreous envelope enclosing a filament or electrodes within, with one end of the lamp envelope terminating in an elongated tubular portion of a precise, predetermined length with respect to the optical center of the lamp. By precision tubulation is meant that the lamp is made with the filament or arc electrodes precisely aligned along the axis of the tubular portion and that the tubular portion of the lamp is of a precise, predetermined length with respect to the optical center of the lamp. The tubular portion is inserted directly into and secured in a bore of predetermined length either in the base of a reflector or into a lamp mount without means for adjusting the position of the lamp in either the reflector or the mount. The elongated tubular portion of the lamp will be one end of the vitreous tubing from which the lamp was formed. The hole in the reflector base or lamp mount into which the elongated tubular portion fits is precision molded or machined so that the optical center of the lamp is held in position within the required limits without any need for adjustment of the position of the lamp with respect to the focal point of the reflector once the lamp or lamp and mount assembly is inserted into or attached to the reflector.

In order to achieve this result the tolerance on the length of both the elongated tubular portion of the lamp and the bore into which it is inserted with respect to the optical center of the lamp must be within about ten percent (±10%) of the length of the filament or the length of the arc, the length of the arc being taken as the distance between the arc electrodes. In the case of miniature arc lamps useful with this invention, a typical arc length will range between about 2–3 mm, so that the length of the bore and of the elongated tubular portion of the lamp will be of a combined precision to within a few tenths of a millimeter.

In one embodiment, the present invention relates to an assembly of a lamp and a plastic reflector having an integrally molded base portion wherein said lamp comprises a vitreous envelope containing electrodes or a filament within, said envelope terminating at one end in an elongated tubular portion of a precise, predetermined length with respect to the optical center of said lamp with at least a portion of said tubular portion being inserted directly into a bore in said base of said reflector, said bore and said elongated tubular lamp portion being dimensioned with respect to their lengths such that combined tolerances of said lengths are within ±10% of the length of the arc or filament so that when said lamp is secured within said bore the optical center of said lamp is at about the focal point of said reflector. That portion of the base of the reflector into which the tubular lamp portion is inserted will be constructed of electrically non-conductive and preferably plastic material as an integral part of the reflector. In another embodiment, the lamp will be secured in a bore in a lamp mount which is then secured in a reflector. The length of the bore in both the mount into which the tubular lamp portion is inserted and of the tubular lamp portion with respect to the optical center of the lamp, are dimensioned to have a predetermined length accurate to within about ten percent (±10%) of the arc or filament length. The elongated tubular portion of the lamp may be secured in said bore by means of a press fit, by means of gaskets, set screws, adhesive, collets or chucks, or any combination or other means suitable and made of electrically non-conductive material which is able to withstand the heat transmitted through the lamp tube from the arc or filament.

Means for producing arc lamps and filament containing incandescent lamps such as tungsten-halogen lamps useful in the practice of this invention, and particularly relatively small lamps, have been disclosed, for example, in U.S. Pat. No. 4,810,932 the disclosures of which are incorporated herein by reference. In this patent a method is disclosed for producing arc lamps and double-ended tungsten-halogen incandescent lamps blown from a single piece of lamp tubing and having at least one elongated tubular end. Arc lamps made by this process and having the centering coils described below for centering the arc electrodes have been fabricated having the electrodes radially aligned within three-tenths, two)tenths and even one-tenth of a millimeter of the longitudinal lamp axis and lamp tube. Similarly, incandescent filament lamps have been made with the filament axially aligned to within seven-tenths of a millimeter and even five-tenths (i.e., ±0.5 mm) of a millimeter of the longitudinal lamp axis for a filament ten millimeters long. In making these lamps with such precision radial alignment of the arc electrodes or filament with respect to the longitudinal lamp tube axis, it is particularly preferred that shrink seals and not press seals be employed when hermetically sealing the vitreous lamp envelope during the lamp manufacturing process, as is also disclosed in U.S. Pat. No. 4,810,932.

DETAILED DESCRIPTION

Figure 1:
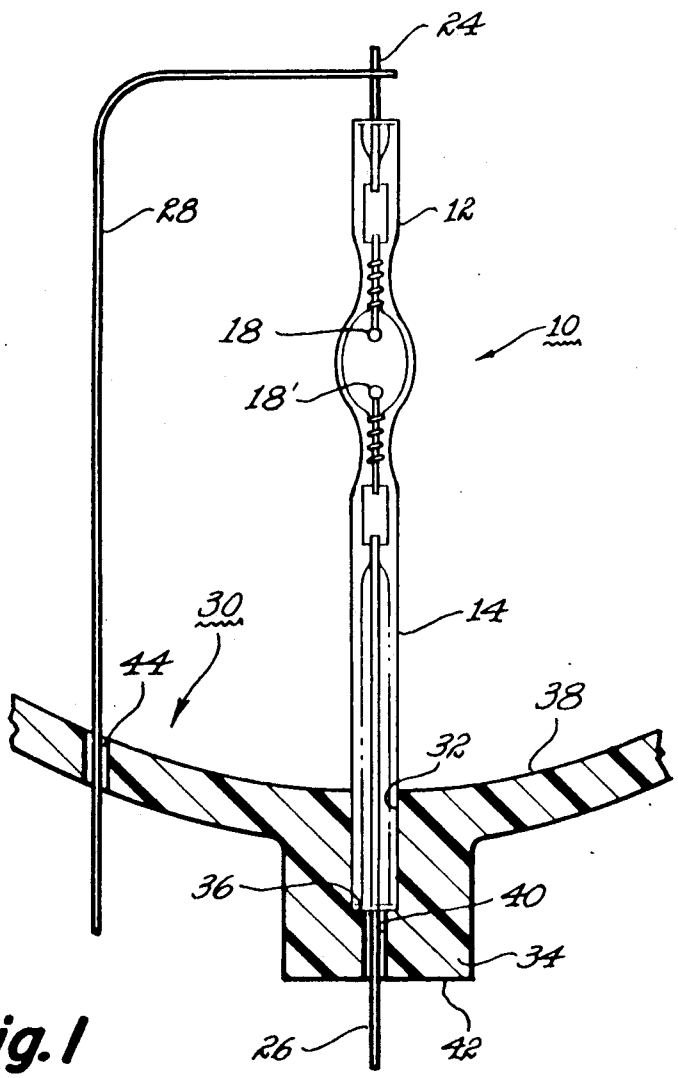
FIG. 1 schematically illustrates one embodiment of the present invention wherein the elongated tubular portion of an arc discharge lamp is press fit directly into a bore in the base of a plastic reflector.

Referring now to FIG. 1, there is shown arc lamp 10 comprising arc discharge tube 12 made of vitreous silica (quartz) having an elongated tubular portion 14 supported by a press fit in bore 32 axially extending through a portion of base 34 of plastic parabolic reflector 30 shown in partial, cut-away view. The length of both lamp tube 14 of lamp 10 and bore 32 in the base 34 of reflector 30 are predetermined from the mid point of the arc, defined by the distance between electrodes 18-18', to be of a combined precision within ±10% of the length 18-18', so that when lamp tube 14 seats at wall portion 36 of bore 32, the mid point of arc 18-18' is at about the focal point of reflecting surface 3 (shown in cut-away fashion) of reflector 30. Lamp 10 may also be held in bore 32 in base 34 by any suitable and convenient means such as a relatively high temperature adhesive, a set screw, etc. If an adhesive is used, bore 40 through which hot lead 26 exits base 34 will be large enough to provide an exit for any surplus adhesive or other means may be employed, such as holes or grooves in the bore 32. The bottom of bore 32 terminates in an area of reduced cross section 36 having bore 40 axially extending from the center of bore 32 to the bottom 42 of plastic base 34, thereby providing a path for high voltage lead 26 of lamp 10 which exits through bore 40 for connection to the high voltage end of a starting transformer (not shown). Ground lead 24 of lamp 10 exits through the top portion thereof where it is connected to conductor 28 which extends away from lamp 10 and passes through hole 44 in the reflector portion 38 of reflector 30 for connection to a ground.

Figure 2:
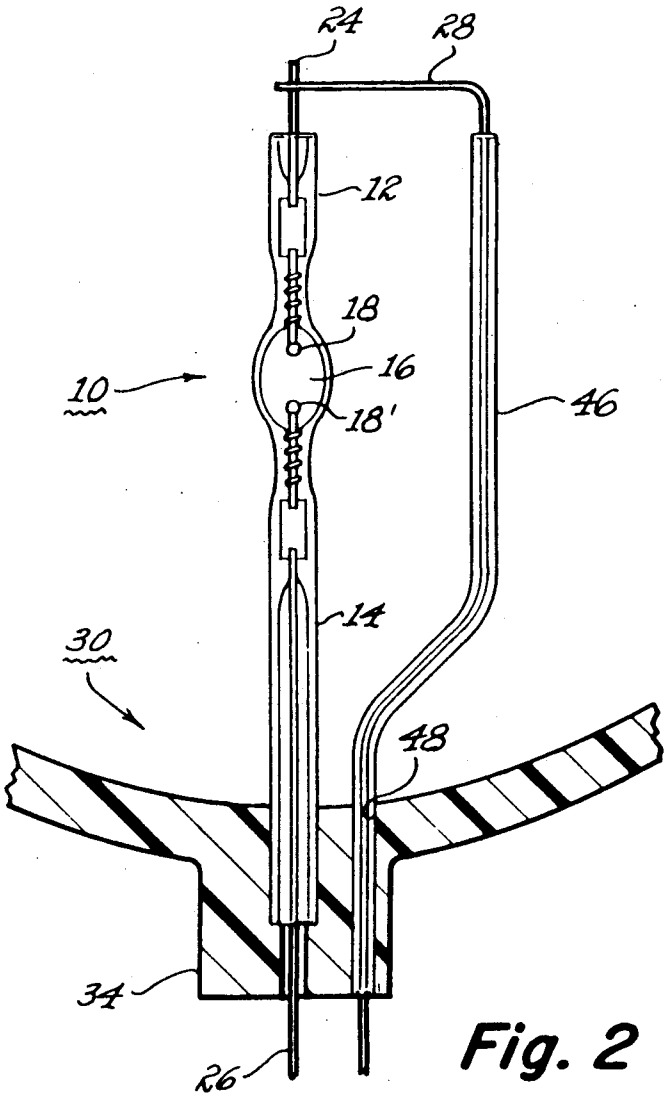
FIG. 2 represents another embodiment of the invention similar to that of FIG. 1, but where the ground lead of the lamp passes through the base of the reflector instead of through the parabolic reflecting portion.

FIG. 2 schematically illustrates another embodiment of the present invention wherein lamp 10 is mounted in base portion 34 of reflector 40 in a similar fashion, but wherein ground conductor 28 passes through vitreous tube 46 and out through base 34 for connection to a ground. Vitreous shield 46 is inserted into bore 48 of base 34. Vitreous tube 46 is employed as an insulation shield over conductor 28 because of the closer proximity of conductor 28 to arc tube 10 and hot lead 26. Shield 46 may be made of any suitable vitreous material such as a glass, quartz or a ceramic material. Glass is preferred because it absorbs UV radiation and thus minimizes photon generation at conductor 28 which, because of its proximity to lamp 10 would slowly deplete arc chamber 16 of sodium present therein, thereby shortening the life of the lamp.

Figure 3:
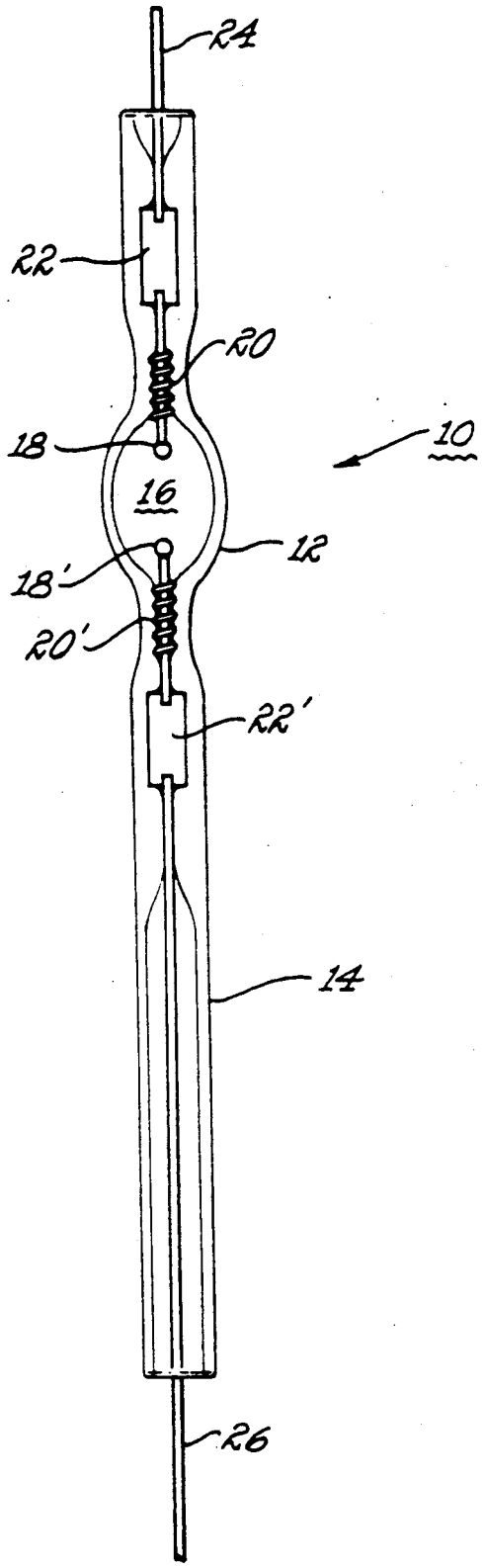
FIG. 3 schematically illustrates an arc lamp having an elongated tubular portion and electrode centering coils suitable for use with the present invention.

FIG. 3 schematically illustrates a particular type of miniature metal halide arc discharge lamp that has been successfully employed in the practice of the present invention. Means for manufacturing such a lamp having an elongated tubular portion as depicted, are known to those skilled in the art and may be found in U.S. Pat. No. 4,810,932 the disclosures of which have been incorporated herein by reference. Turning now to FIG. 3, lamp 10 is illustrated comprising vitreous envelope 12 made of quartz having an elongated tubular portion 14. The lamp contains an arc chamber 16 having electrodes 18 and 18' hermetically sealed therein by means of shrink seals around molybdenum foil members 22 and 22' to which the electrodes are welded. Shrink seals are known to those skilled in the art and an example of how to obtain shrink seals may be found, for example, in U.S. Pat. No. 4,389,20 the disclosures of which are incorporated herein by reference as well as in U.S. Pat. No. 4,810,932. Centering coils 20 and 20', made out of a suitable high temperature material such as tungsten, insure precision radial alignment of the electrodes within the arc chamber. Top projecting lead wire 24 is connected to the other end of molybdenum foil seal 22 and bottom projecting lead wire 26, which is the high voltage lead, is shown projecting through and exiting the elongated portion 14 of lamp 10.

Figure 4:
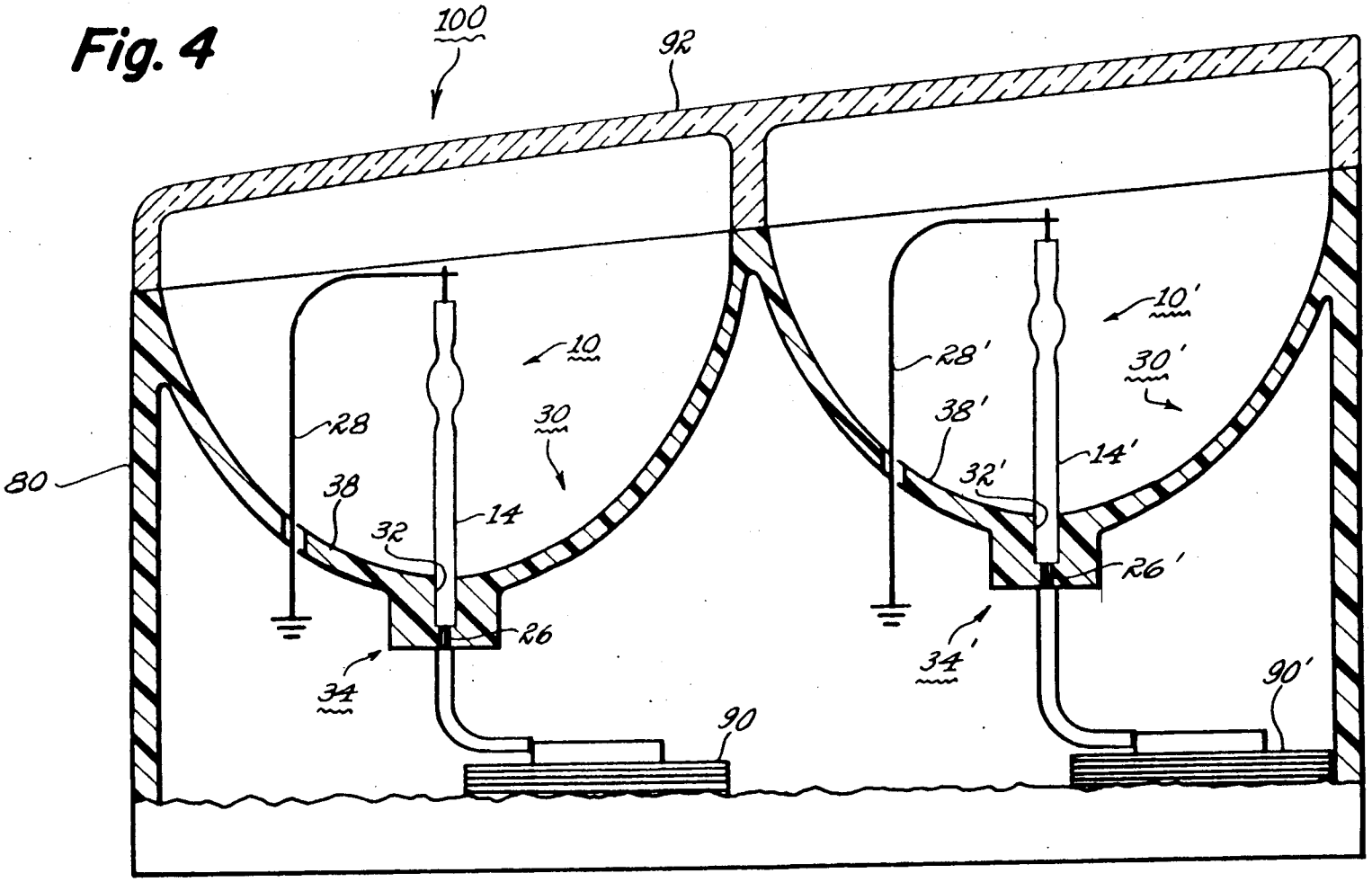
FIG. 4 schematically illustrates another embodiment of the present invention useful for automotive lighting wherein two arc tubes are press fit into the nose or base portions of two combined plastic reflectors associated with an integral housing portion containing electronics for starting and operating the lamps.

FIG. 4 schematically illustrates yet another embodiment of the present invention wherein the elongated tubular portions 14 and 14' of lamps 10 and 10' are inserted directly into bores 32 and 32' of integrally molded plastic base portions 34 and 34' in reflectors 30 and 30' in a fashion similar to that described for the integral reflector mount in FIGS. 1 and 2. High voltage lamp leads 26 and 26' are shown connected to high voltage transformers 90 and 90', shown in partial cutaway fashion, which are contained in housing 80 which forms an integral part of overall lamp assembly 100. Lens portion 90 is hermetically sealed to assembly 100. Ground leads 28 and 28' of lamps 10 and 10' exit through reflector walls 38 and 38' into housing 80 wherein they are connected to a suitable ground (not shown).

Figure 5:
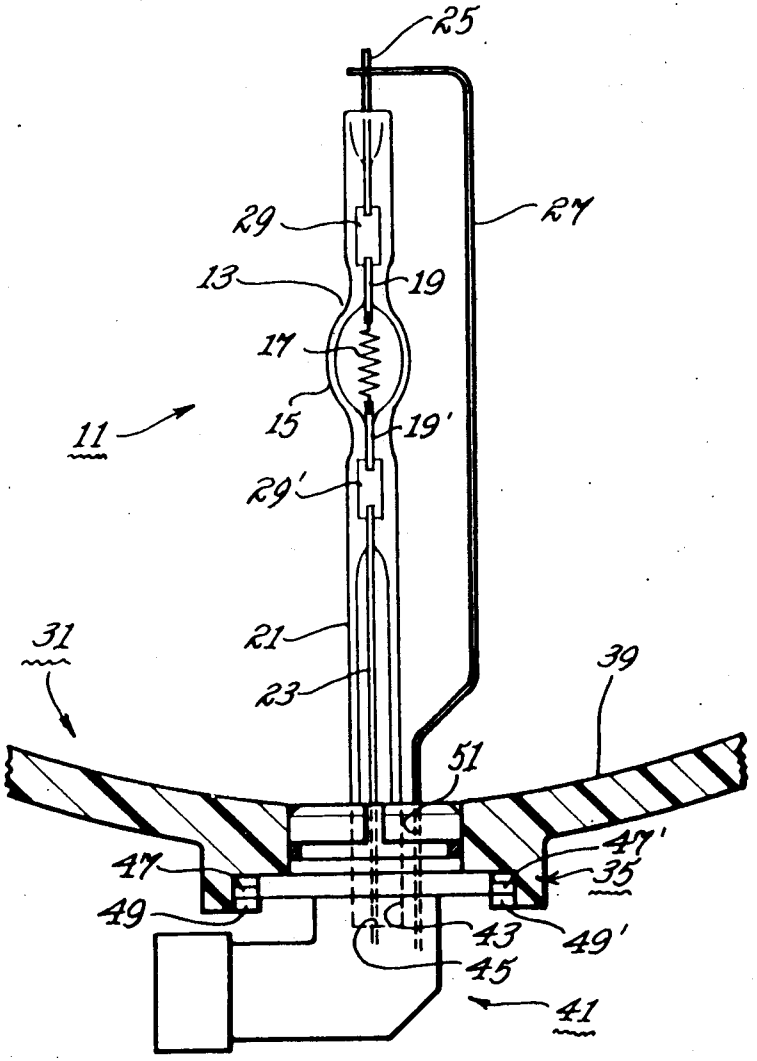
FIG. 5 schematically illustrates another embodiment of the present invention wherein the tube of a tungsten-halogen lamp is inserted via a press fit into a plastic lamp mount which is mounted on a reflector.

Turning now to FIG. 5, lamp 11 comprises a vitreous quartz or high temperature aluminosilicate glass envelope 13 having a filament chamber 15 enclosing tungsten filament 17 connected at opposite ends to molybdenum inlead wires 19 and 19' and having an elongated tubular portion 21. Lamp 11 is supported in a precision molded bore or hole 43 in plastic mount 41. The bottom of bore 43 terminates in an area of reduced cross section 45 having another bore (not shown) extending from the center of 45 into base 41 for connecting hot lead 23 to a source of electricity (not shown) in a standard fashion. Ground lead 25 of lamp 11 exits through the top portion thereof where it is connected to conductor 27 which passes through a bore 51 in mount 41. Molybdenum foils 29 and 29' are shrink sealed into the envelope 13 to provide a hermetic seal and an electrical path from inlead 23 to ground lead 25. Mount 41 is attached to base 35 of reflector 31 by mounting tabs molded as an integral part of said base of which two, 47 and 47', are illustrated in the Figure. Locking tabs in base 35, illustrated by 49 and 49', serve to secure the mount in the base as is known to those skilled in the art.

Arc lamps having vitreous silica (quartz) envelopes generally operate at inner envelope wall temperatures of about 750–900° C., whereas tungsten-halogen lamps having high temperature glass envelopes operate at about 300–700° C. and higher if quartz envelopes are used. Accordingly, the plastic into which the elongated tubular lamp portion is inserted will be made of an electrically non-conductive plastic material capable of being molded or machined and having sufficient heat resistance to be able to be used with the present invention without being distorted or melted from the heat emitted by the arc and also conducted from the arc chamber of the lamp by the lamp tube 14. Suitable high temperature resistant plastics include materials such as Teflon, polysulfones, liquid crystal polymers, such as Vectra A130 by Celanese Corporation, polyetherimides such as Ultem by GE and polyphenylene sulfides such as Supec by GE and Ryton by Philips.

What is claimed is:

1. A lamp and reflector assembly wherein said lamp is a miniature arc discharge lamp comprising a vitreous arc chamber containing a pair of spaced apart electrodes hermetically sealed within, said arc chamber terminating at one end in a tubular stem portion, said lamp having an optical center at about the mid point of the distance between said electrodes, wherein said reflector is molded out of plastic having an integrally molded plastic base portion located at the rear thereof which contains a bore of which one end opens into said reflector and the other end terminates in at least a partial wall or stop, with said lamp stem secured in said bore and terminating at said wall or stop, wherein the length of said stem and said bore are of a precision such that the combined length thereof have a dimensional tolerance of within plus or minus 10% of the distance between said lamp electrodes so that the mid point of said arc of said lamp when energized is at about the focal point of said reflector.

2. The assembly of claim 1 wherein said electrodes are hermetically sealed in said vitreous lamp envelope by means of shrink seals.

3. The assembly of claim 2 wherein said bore in said reflector base is electrically non-conductive.

4. The assembly of claim 3 wherein said lamp has been fabricated from a single piece of vitreous material.

5. The assembly of claim 4 wherein said lamp is secured in said reflector solely by said lamp stem in said bore.

6. The assembly of claim 5 wherein said lamp stem is press fit into said bore.

7. The assembly of claim 6 wherein said electrodes are radially aligned in said lamp within three-tenths of a millimeter of the longitudinal axis of said lamp stem.

8. A lamp and reflector assembly wherein said lamp is a miniature incandescent lamp comprising a vitreous filament chamber containing a filament hermetically sealed within, said filament chamber terminating at one end in a tubular stem portion, said lamp having an optical center at about the mid point of said filament, wherein said reflector is molded out of plastic having an integrally molded plastic base portion located at the rear thereof which contains a bore of which one end opens into said reflector and the other end terminates in at least a partial wall or stop, with said lamp stem secured in said bore and terminating at said wall or stop and wherein the length of said stem and said bore are of a precision such that the combined length thereof have a dimensional tolerance of within plus or minus 10% of the length of said lamp filament so that the mid point of said filament of said lamp when energized is about the focal point of said reflector.

9. The assembly of claim 8 wherein said filament is hermetically sealed in said vitreous lamp envelope by means of shrink seals.

10. The assembly of claim 9 wherein said bore in said reflector base is electrically non-conductive.

11. The assembly of claim 10 wherein said lamp has been fabricated from a single piece of vitreous material.

12. The assembly of claim 11 wherein said lamp is secured in said reflector solely by said lamp stem in said bore.

13. The assembly of claim 12 wherein said lamp stem is press fit into said bore.

14. The assembly of claim 13 wherein said filament is radially aligned in said lamp within three-tenths of a millimeter of the longitudinal axis of said lamp stem.

15. A replaceable lamp assembly for an automotive headlamp comprising an electric lamp in a lamp mount wherein said lamp is a miniature lamp comprising a vitreous arc or filament chamber containing a pair of spaced apart electrodes or a filament hermetically sealed within, said chamber terminating at one end in a tubular stem portion, said lamp having an optical center at about the mid point of said filament or the distance between said electrodes, wherein said mount contains a bore of which one end is open and the other end terminates in at least a partial wall or stop, with said lamp stem secured in said bore and terminating at said wall or stop wherein the length of said stem and said bore are of a precision such that the combined length thereof have a dimensional tolerance of within plus or minus 10% of the distance between said lamp electrodes or the length of said filament so that the mid point of said arc or filament of said lamp when energized will be at about the focal point of a reflector when said assembly is coupled to said reflector.

16. The assembly of claim 15 wherein said filament of said electrodes are hermetically sealed in said vitreous lamp envelope by means of shrink seals.

17. The assembly of claim 16 wherein said bore in said mount is electrically non-conductive.

18. The assembly of claim 17 wherein said lamp has been fabricated from a single piece of vitreous material.

19. The assembly of claim 18 wherein said lamp is secured in said reflector solely by said lamp stem in said bore.

20. The assembly of claim 19 wherein said lamp stem is press fit into said bore.

21. The assembly of claim 20 wherein said filament or electrodes are radially aligned in said lamp within three-tenths of a millimeter of the longitudinal axis of said lamp stem.

* * * * *